US008007264B2

(12) United States Patent
Drew et al.

(10) Patent No.: US 8,007,264 B2
(45) Date of Patent: Aug. 30, 2011

(54) POSITIVE DISPLACEMENT PUMP APPARATUS AND METHOD

(75) Inventors: Van Norman J. Drew, Whitewater, WI (US); Hagen Curt, Delavan, WI (US)

(73) Assignee: SPX Corporation, Charlotte, NC (US)

( * ) Notice: Subject to any disclaimer, the term of this patent is extended or adjusted under 35 U.S.C. 154(b) by 1146 days.

(21) Appl. No.: 11/730,680

(22) Filed: Apr. 3, 2007

(65) Prior Publication Data

US 2008/0069707 A1 Mar. 20, 2008

Related U.S. Application Data

(60) Provisional application No. 60/836,122, filed on Aug. 8, 2006.

(51) Int. Cl.
*F01C 1/18* (2006.01)
*F01C 1/24* (2006.01)
*F03C 2/00* (2006.01)

(52) U.S. Cl. ..... 418/206.1; 418/132; 418/141; 418/206.6; 418/206.7; 418/206.8

(58) Field of Classification Search ..... 418/131–132, 418/141, 104, 206.1, 206.2, 206.6–206.8
See application file for complete search history.

(56) References Cited

U.S. PATENT DOCUMENTS

| | | | | |
|---|---|---|---|---|
| 4,293,290 | A * | 10/1981 | Swanson | 418/206.7 |
| 5,370,514 | A * | 12/1994 | Morita et al. | 418/206.1 |
| 5,924,855 | A * | 7/1999 | Dahmlos et al. | 418/91 |
| 6,328,547 | B1 * | 12/2001 | Morita | 418/206.1 |
| 6,758,660 | B2 * | 7/2004 | Kriehn et al. | 418/91 |

FOREIGN PATENT DOCUMENTS

| | | | |
|---|---|---|---|
| EP | 444941 | A1 * | 9/1991 |
| JP | 05164076 | A * | 6/1993 |

* cited by examiner

*Primary Examiner* — Theresa Trieu
(74) *Attorney, Agent, or Firm* — Baker & Hostetler LLP

(57) ABSTRACT

An improved positive displacement rotary pump apparatus and method is provided. The pump may include a front cover, a rotor body forming a chamber with the front cover, a gear case supporting a pair of hollow drive shafts, and a pair of rotors disposed in the chambers and each detachably mounted to one end of a respective hollow drive shaft via a stud that extends from the rotor through the hollow shaft to a fastener.

17 Claims, 20 Drawing Sheets

POSITIVE DISPLACEMENT PUMP APPARATUS AND METHOD

CROSS REFERENCE TO RELATED APPLICATIONS

This application claims priority to Provisional Patent Application Ser. No. 60/836,122 filed Aug. 8, 2006, the entire disclosure of which is hereby incorporated herein by reference in its entirety.

BACKGROUND OF THE INVENTION

Pumps are in wide use in industry. One popular type of pump for certain applications is known as a rotary positive displacement pump. Such pumps have two counter-rotating rotors that form a moving entrapped volume between the rotor and the inside of a stationary body forming a chamber inside which the rotors move, thus forcing the material from an inlet on the body to an outlet on the body. This type of pump has many applications including for example in the processing of food, chemicals, paint, cosmetics and other materials. In some cases the rotors have intermeshing lobes. In other designs the rotors have wing shaped projections that form moving circumferential pistons together with the inside of a swept body cavity.

Usually, such pumps are subject to cleaning procedures, and also servicing for repair or replacement of wearable parts, from time to time. While all rotary displacement positive displacement pumps are able to be disassembled to some extent, depending on the application, it may be more desirable to either disassemble the pump for each cleaning, or to instead perform clean-in-place procedures where the pump is cleaned by flushing with cleaning and/or rinsing materials.

SUMMARY OF THE INVENTION

Some embodiments of the present invention provide an improved positive displacement rotary pump apparatus and method.

In one aspect, a pump is provided having a front cover, a pump body forming a chamber with the front cover, a pair of hollow drive shafts, a gear case supporting the pair of hollow drive shafts, with each drive shaft having a first end and a second end, a pair of mounting studs, a pair of fasteners, and a pair of rotors disposed in the chamber and each detachably mounted to a first end of a respective hollow drive shaft via a respective mounting stud that extends from the rotor through the hollow drive shaft to a respective fastener.

In another aspect, a pump is provided having a front cover, means for forming a chamber with the front cover, a pair of hollow drive shafts, means for supporting the pair of hollow drive shafts, a pair of mounting studs, a pair of fastening means, and a pair of rotors disposed in the chamber and each detachably mounted to a first end of a respective hollow drive shaft via a respective mounting stud that extends from the rotor through the hollow drive shaft to a respective fastening means.

In another aspect, a pumping method is provided that includes providing a front cover, a rotor body forming a chamber with the front cover, a gear case supporting a pair of hollow drive shafts, and a driving pair of rotors disposed in the chamber using the drive shafts, with each drive shaft being detachably mounted to one end of a respective hollow drive shaft via a stud that extends from the rotor through the hollow shaft to a fastener.

In another aspect, a pump is provided having a front cover, a pump body forming a chamber with the front cover, a pair of hollow drive shafts, a gear case supporting the pair of hollow drive shafts, a pair of rotors disposed in the chambers, and at least one respective face seal between each rotor and the body having at least one first rotating seal ring disposed at the backward facing face of each rotor, and at least one respective second stationary rotating seal ring disposed on a forward facing face of the pump body.

In another aspect, a pump is provided having a front cover, means for forming a chamber with the front cover, a gear case supporting a pair of hollow drive shafts, a pair of rotors disposed in the chambers, and at least one respective sealing means between each rotor and the body having at least one first rotating seal ring disposed at the backward facing face of each rotor, and at least one respective second stationary rotating seal ring disposed on a forward facing face of the chamber forming means.

In another aspect, a pumping method is provided that includes providing a front cover, a pump body forming a chamber with the front cover, and a gear case supporting a pair of hollow drive shafts, a pair of rotors disposed in the chambers, and providing a seal of the chamber by providing at least one respective face seal between each rotor and the body by at least one first rotating seal ring disposed at the backward facing face of each rotor, and at least one respective second stationary rotating seal ring disposed on a forward facing face of the pump body. In one aspect, a pump is provided having a front cover, a pair of hollow drive shafts, a pump body forming a chamber with the front cover; a gear case supporting the drive shafts; and a pair of rotors disposed in the chambers, wherein each rotor is driven by a respective drive shaft and each drive shaft is mounted by a pair of bearings that rotatably support the shaft in the gear case, with each bearing being located relative to the gear case by a respective locating ring that is axially movable relative to the gear case, so that each bearing is axially adjustable relative to the gear case.

In another aspect, a pump is provided having a front cover, a pair of hollow drive shafts, a pump body forming a chamber with the front cover, means for supporting the pair of hollow drive shafts; and a pair of rotors disposed in the chambers, wherein each rotor is driven by a respective drive shaft and each drive shaft is mounted by a pair of bearing means that rotatably support the shaft in the gear case, with each bearing means being located relative to the gear case by a respective locating ring that is axially movable relative to the gear case, so that each bearing means is axially adjustable relative to the gear case.

In another aspect, a pumping method is provided that includes providing a front cover, a pair of hollow drive shafts, a rotor body forming a chamber with the front cover, a gear case supporting a pair of hollow drive shafts, and a pair of rotors disposed in the chambers; and mounting each shaft by a pair of bearings to rotatably support the shaft in the gear case, with each bearing being located relative to the gear case by a respective locating ring that is axially movable relative to the gear case, so that each bearing is axially adjustable relative to the gear case.

In another aspect, a pump is provided having a front cover, a pair of hollow drive shafts, a pump body forming a chamber with the front cover, a gear case supporting the drive shafts; and a pair of rotors disposed in the chambers, wherein each rotor is driven by a respective drive shaft and each drive shaft is mounted by a pair of tapered bearings to rotatably support the shaft in the gear case, with each bearing being located relative to the gear case by a respective locating ring that is axially movable relative to the gear case, so that the internal clearance of each bearing is adjustable by adjusting the distance between the locating rings.

In another aspect, a pump is provided having a front cover, a pair of drive shafts, a pump body forming a chamber with the front cover, means for supporting the drive shafts, and a pair of rotors disposed in the chambers, wherein each shaft is driven by a respective drive shaft and each drive shaft is mounted by a pair of tapered bearing means to rotatably support the shaft in the supporting means, with each bearing means being located relative to the supporting means by a respective locating ring that is axially movable relative to the supporting means, so that the internal clearance of each bearing is adjustable by adjusting the distance between the locating rings.

In another aspect, a pumping method is provided that includes providing a front cover, a pair of drive shafts, a rotor body forming a chamber with the front cover, a gear case supporting the pair of drive shafts, and a pair of rotors disposed in the chambers and mounting each shaft by a pair of tapered bearings to rotatably support the shaft in the gear case, with each bearing being located relative to the gear case by a respective locating ring that is axially movable relative to the gear case, so that the internal clearance of each bearing is adjustable by adjusting the distance between the locating rings.

In one aspect, a pump is provided having a front cover, a rotor body forming a chamber with the front cover and having an inlet port and an outlet port, a pair of drive shafts, a gear case supporting the pair of drive shafts, and a pair of rotors disposed in the chamber, wherein the front cover forming the front of the rotor chamber has a contoured inner relief region located adjacent one of the inlet port and the outlet port, and located next to the front of the rotor swept area to facilitate movement of material through the pumped rotor area.

In another aspect, a pump is provided having a front cover, enclosure means for forming a chamber with the front cover and having an inlet port and an outlet port, a pair of drive shafts, means for supporting the pair of drive shafts, and a pair of rotors disposed in the chamber, wherein the front cover forming the front of the rotor chamber has a contoured inner relief region located adjacent one of the inlet port and the outlet port, and located next to the front of the rotor swept area to facilitate movement of material through the pumped rotor area.

In yet another aspect, a pumping method is provided which includes providing a front cover, a rotor body forming a chamber with the front cover and having an inlet port and an outlet port, a gear case supporting a pair of drive shafts, and a pair of winged rotors disposed in the chamber, and pumping the material from the inlet to the outlet, with the front cover forming the front of the rotor chamber which has a contoured inner relief region located adjacent one of the inlet port and the outlet port, and located next to the front of the rotor swept area to facilitate movement of material through the pumped rotor area.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
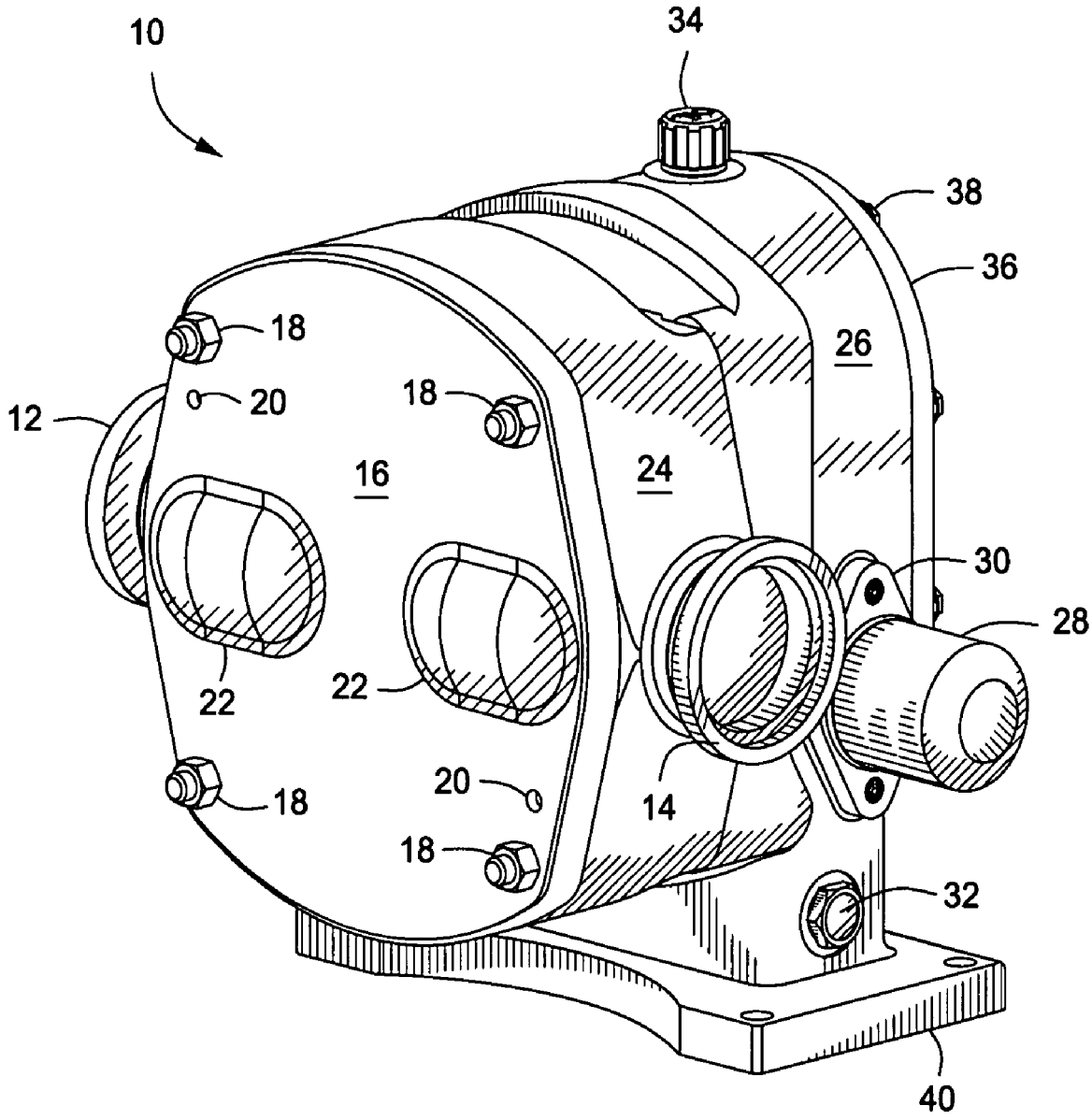
FIG. 1 is a perspective view of a pump according to an example of a preferred embodiment of the present invention.

Some embodiments of the present invention provide an improved positive displacement rotary pump apparatus and method. Examples will be discussed below with reference to the drawing figures in which like reference numerals refer to like parts throughout.

Figure 2:
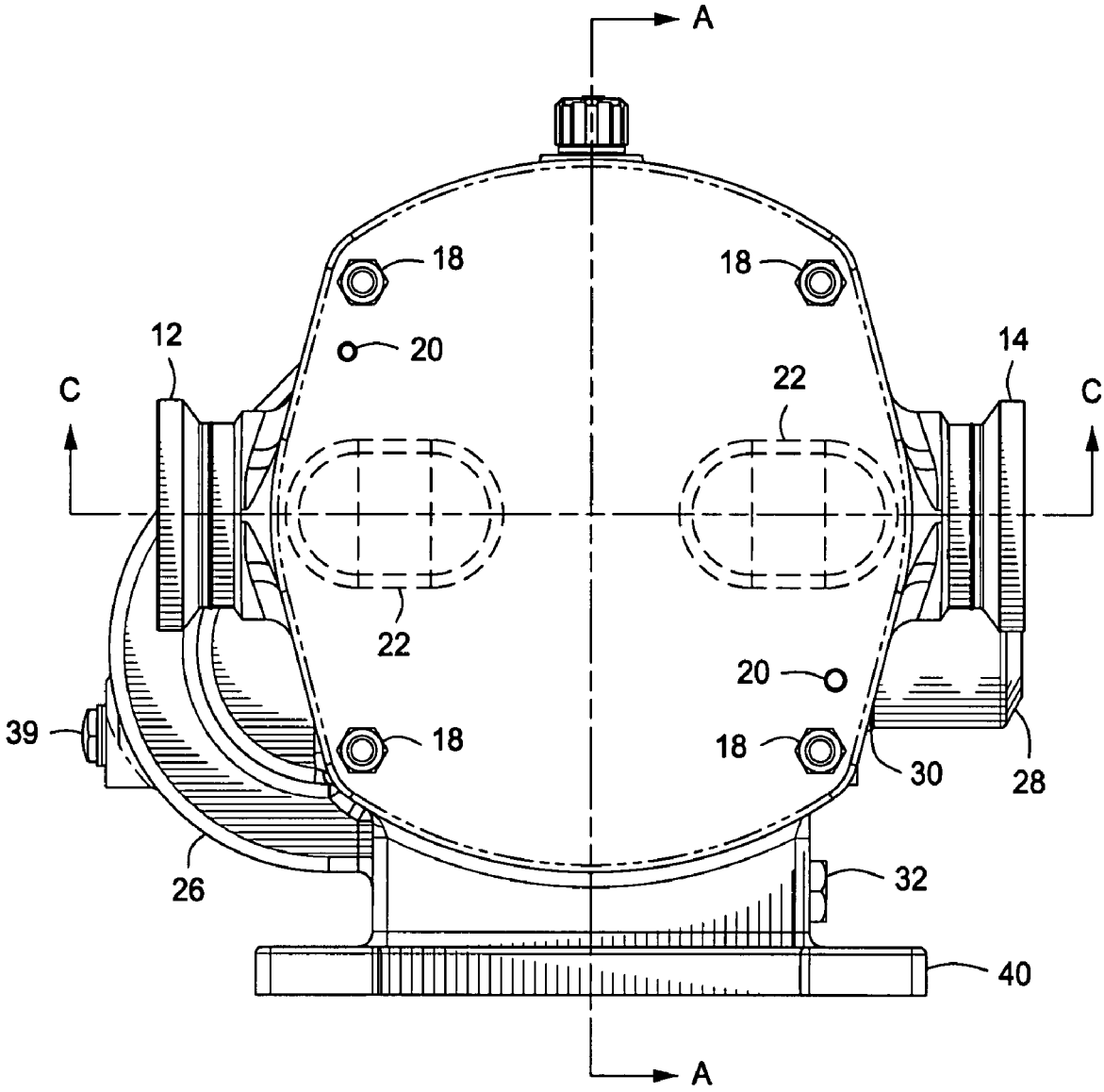
FIG. 2 is a front view of the pump.

FIGS. 1 and 2 illustrate a pump 10 having an inlet port 12 and an outlet port 14. The illustrated embodiment is bi-directional, in that it can pump in either direction, so the selection of inlet and outlet is given for example only in this description. Changing direction of the pump is accomplished simply by changing the direction of rotation of the motor or gear reducer that is driving the pump. The pump has a front cover 16 mounted by a series of bolts 18, and alignment features such as dowel pin holes 20, to a body 24. The dowel pins and holes 20 serve to align the front cover 16 with the body 24.

The front cover 16 and body 24 substantially define an internal chamber for the internal rotors which are not visible in this view. The cover 16 on its outside shows a pair of domed regions 22, which generally correspond to internal relief areas which are discussed in more detail below. The relief areas can be implemented with our without showing an external dome depending on the thickness of the front cover 16, the depth of the internal relief, and the manufacturing method for the front cover 16.

The body 24 is attached to a gear case 26, which supports drive shafts for the rotors, which are not visible in this view. Bolts 18 also extend through the body 24 and mount the body 24 to the gear case 26, with this also being aligned by the dowel pins and holes 20. Mounted to the gear case 26 is a filter 28 which is part of a pump assembly 30 that circulates and filters lubricating fluid or oil inside the gear case 26. An oil drain plug 32 is shown, as well as on oil fill and breather cap 34.

A rear cover 36 encloses the back of the gear case 26, and is mounted thereto by a series of bolts 38. Although the rear cover is a separate part from the gear case 26, it is included below as a part of the overall gear case structure. A sight glass 39 is provided for externally viewing the oil level in the gear case 26. The gear case 26 also has a base 40 on which the pump rests and which can provide a stable mounting arrangement. This description will refer to the pump as being in a vertical orientation with the base 40 on a horizontal surface and will use the directions up and down to refer to when the pump is in this orientation. However, the pump can function also when turned sideways (with the base mounted to a vertical surface), or even in any orientation. Such different orientation might change the functionality of the oil pump assembly 30. However, the oil pump pickup and distribution locations can be altered as desired so that oil is drawn from wherever the lower internal region of the gear case 26 is located, and released to wherever an upper part of the gear case 26 is located.

Figure 3:
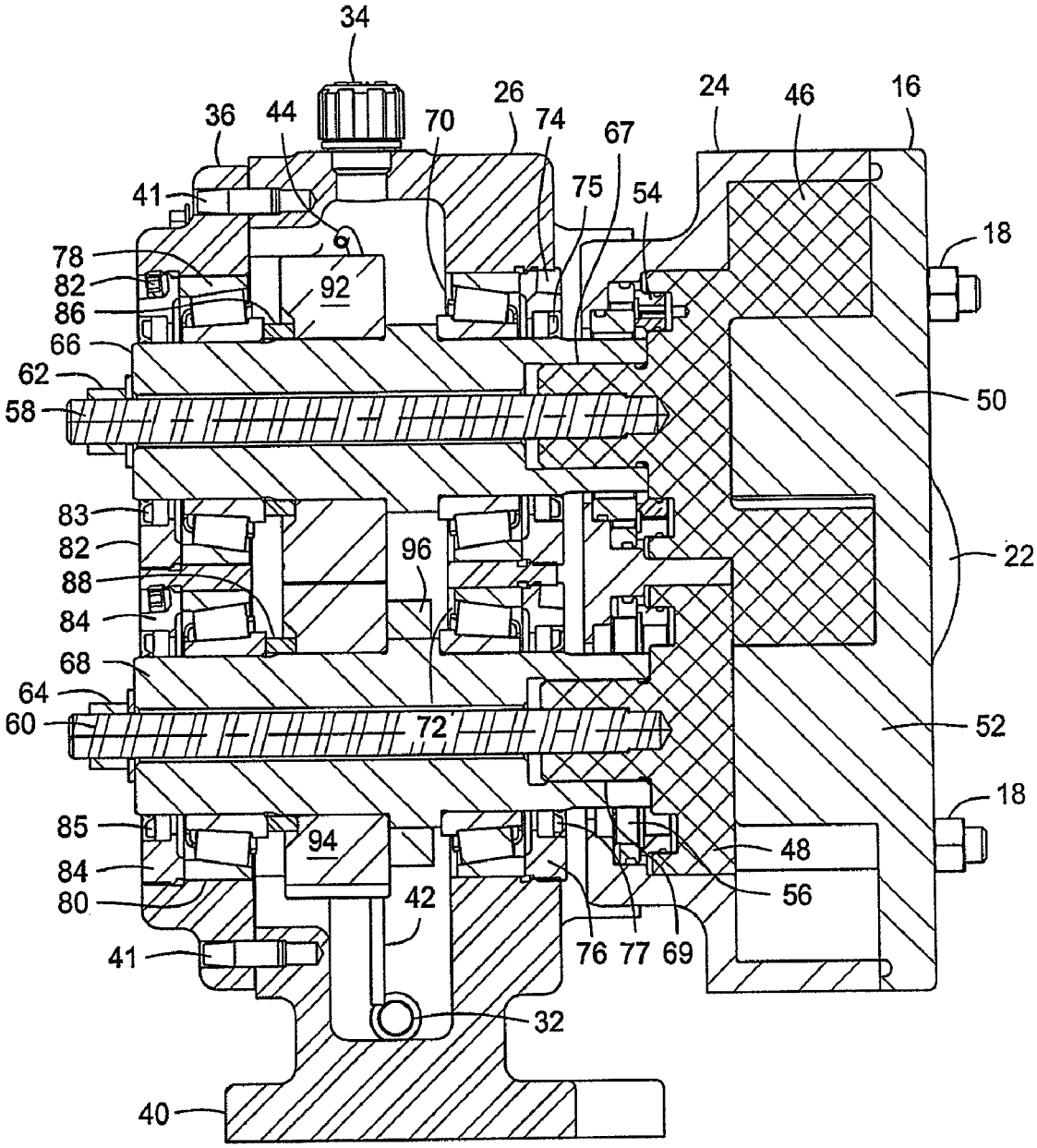
FIG. 3 is a cross-sectional view taken through line A-A in FIG. 2.

FIG. 3 includes the front cover 16, bolts 18, domes 22, body 24, gear case 26, drain plug 32, old fill and breather cap 34, rear cover 36, and base 40 which were described above. The view does not show bolts 18 or locator features 20, nor bolts 38 because those parts are not visible in this view. However, FIG. 3 does depict the locator dowel pins 41 that align the rear cover 36 with the gear case 26.

FIG. 3 does not show the filter 28 and pump 30, which are obscured in this view. However, FIG. 3 shows an oil pump draw tube 42 and an oil pump distribution outlet 44. As is discussed further below, oil is drawn via the draw tube 42, which is located to have its end in a sump in a lower region of the interior of the gear case 26, and is circulated to be distributed out the outlet 44, which may be near the top of the interior of the gear case 26, in order to supply lubrication, cooling, and or noise abatement to the moving parts in the gear case interior. In the example shown, a simple tube outlet 44 is shown, positioned to drip or spray directly onto a drive shaft gear. However, a more complex manifold or drip tray can be used, or internal porting can be used to supply the oil to any internal gears, bearings, or other parts, and also to cool any parts by internal circulation through conduits in parts or by direct application. Also the references to oil in this description include any other lubricating and/or cooling fluid and references to lubrication include not only oil but other lubricants and/or cooling fluids.

The upper rotor 46 and lower rotor 48 each have wing-shaped ears that rotate about an upper hub 50 and lower hub 52 respectively. The upper hub 50 and lower hub 52 are shown in this example as integral with the front cover 16, and project inward to fill the unswept area located radially inward of the rotor wings. As discussed in more detail below, each rotor 46 and 48 has a relatively flat center rear disc portion from which extend forward and outward a pair of wings. The wings essentially act as pistons to move material through a swept internal volume chamber area formed by the inside of the front cover 16 and the body 24. A benefit in some examples of having the hubs 50 and 52 be located in front of the rotors 46 and 48, and as integral with or extending from the front cover 16, is that a close tolerance can be obtained if desired between the hubs 50 and 52 and the unswept area of the rotors 46 and 48. In some cases reducing unswept volume can improve efficiency and/or reduce possible stagnant material in the unswept region.

A generally face seal arrangement for enclosing the material area inside the pump body includes an upper face seal assembly 54 that seals between the rotating rotor 46 and the inside of the stationary body 24, and a lower face seal assembly 56 that seals between the rotating rotor 48 and the inside of the stationary body 24. These seals are depicted and described in more details in FIGS. 4 and 5 and below.

The rotors are supported, driven, and are positioned axially, by being mounted to respective hollow shafts. In the preferred example shown, an upper stud 58 and lower stud 60, respectively, are each permanently or semi-permanently affixed to a respective rotor 46 or 48, and have respective nuts 62 and 64 that attach the shafts 58 and 60 so they extend through the center of hollow drive shafts 66 and 68 respectively. In other embodiments the rotors 46 and 48 may be attached to the drive shafts such as 66 and 68 via other attachment arrangements. A projection at the rear of each rotor 46 and 48 has outer splines that mate with inner splines at the end of each hollow drive shaft 66 and 68. The intermeshed spline areas are labeled 67 and 69, respectively, in FIG. 3.

FIG. 3 also shows an upper front bearing 70, lower front bearing 72, upper front bearing upper front adjustable bearing retainer 74, lip seal 75, lower front adjustable bearing retainer 76, lip seal 77, upper rear bearing 78, lower rear bearing 80, upper rear bearing retainer 82, lip seal 83, lower rear adjustable bearing retainer 84, and lip seal 85.

Each bearing retainer 74, 76, 82, and 84 is axially adjustable and lockable relative to the gear case 26 and rear cover 36, for example by being in the form of an externally threaded ring and residing in an internally threaded bore of the gear case 26 or of the rear cover 36, and having a locking set screw.

An upper spacer ring 86 and lower spacer ring 88 maybe be used as spacers adjacent to upper drive gear 92 and lower drive gear 94 as shown. The drive gears 92 and 94 in this embodiment are for example mounted to the drive shafts 66 or 68 by a splined arrangement used with the shoulder that is shown on each shaft 66 and 68 adjacent to and abutting the drive gears 92 and 94.

Using the upper drive shaft 66 as an example, a load path exists from the upper front adjustable bearing retainer 74, to the outer race of bearing 70, to the tapered roller of bearing 70, to the inner race of bearing 70, to a shoulder on the hollow drive shaft 66, the drive gear 92 via welding and/or the shoulder, to the spacer ring 86, to the inner race of bearing 78, to the tapered roller of bearing 78, to the outer race of bearing 78, and to the upper rear adjustable bearing retainer 82.

Since the retainers 74 and 82 can be set at any desired axial location relative to the gear case 26 and rear cover 36, the distance between them can be adjusted, and also they can be shifted axially while resulting in the same spacing therebetween. In the case of bearings 70 and 78 being tapered, reducing the spacing between the retainers 74 and 82 will tighten up the axial and radial internal clearance or tightness of the bearings. This permits adjustment to a tightness inside the bearing parts that avoids slop and wear, but also does not cause binding. The axial shifting feature permits the axial position of the shaft relative to the gear case 26 to be adjusted, which in turn allows for axial position adjustment of the rotor 46 relative to the stationary parts of the pump, including the gear case 26, but also the body 24 and the cover 16. By virtue of this axial shifting adjustment, the rotor 46 can be located to have a close clearance with the inside of the cover 16, and also the force of axial contact at the seal location 54 can be made to have a desired degree. The lower drive shaft 68 and associated bearings 72 are adjustable in a manner similar to that described above for the upper drive shaft 66.

FIG. 3 also shows an oil pump cam 96, which is asymmetrical, in that its diameter is not constant from the axis, although the asymmetrical shape is not seen in this view. Since the oil pump cam 96 is at the largest diameter part of the shaft 68, and since it can be smaller than its shaft's respective bearing retainer opening in the gear case 26, it can be directly welded to the shaft 68 if desired. The oil pump cam 96 can alternatively be disposed on the other shaft 66, or any other rotating shaft in the pump. The operation of the oil pump is described in further detail with reference to FIGS. 18 to 23 and also below.

One feature of this embodiment is that by using substantially only four lip seals, including the four lip seals 75, 77, 83, and 85, an enclosed chamber is provided by the gear case 26 and rear cover 36 that encloses the shaft bearings, drive gears, and oil pump cam, in a compact fashion if desired. There is also a fifth seal: a drive shaft lip seal 126, which is discussed below. This creates an arrangement that facilitates lubrication, cooling and/or noise reduction, while reducing the need for additional seals, and also keeps the lubricant away from the material seals 54 and 56 at the rotors. In the illustrated arrangement, even if lubricant breaches one of the four lip seals, it exits the pump to the environment, so it can be detected visually and also does not immediately contact the material seals 54 and 56.

Figure 4:
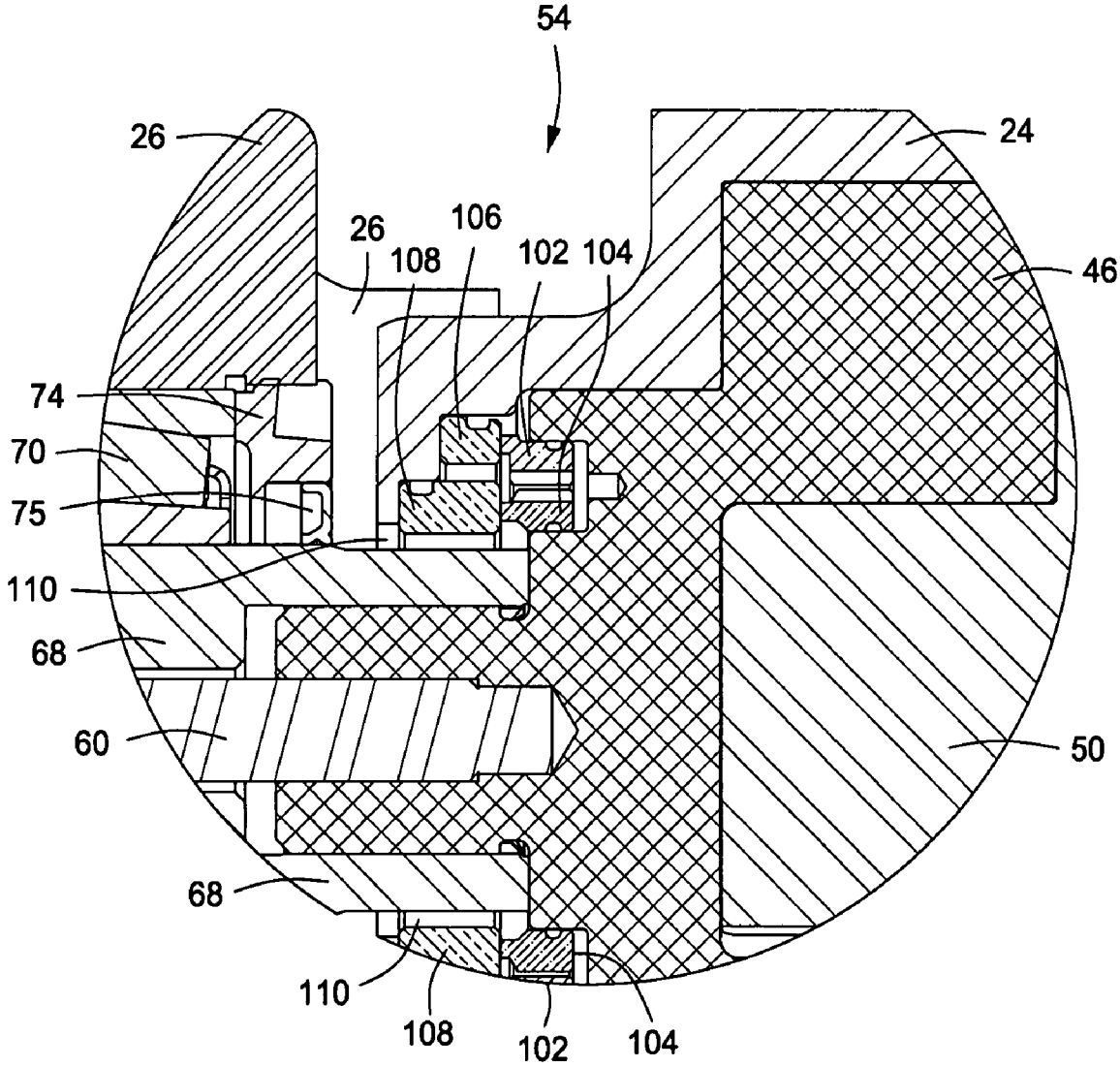
FIG. 4 is a detail view of a portion of FIG. 3.
Figure 5:
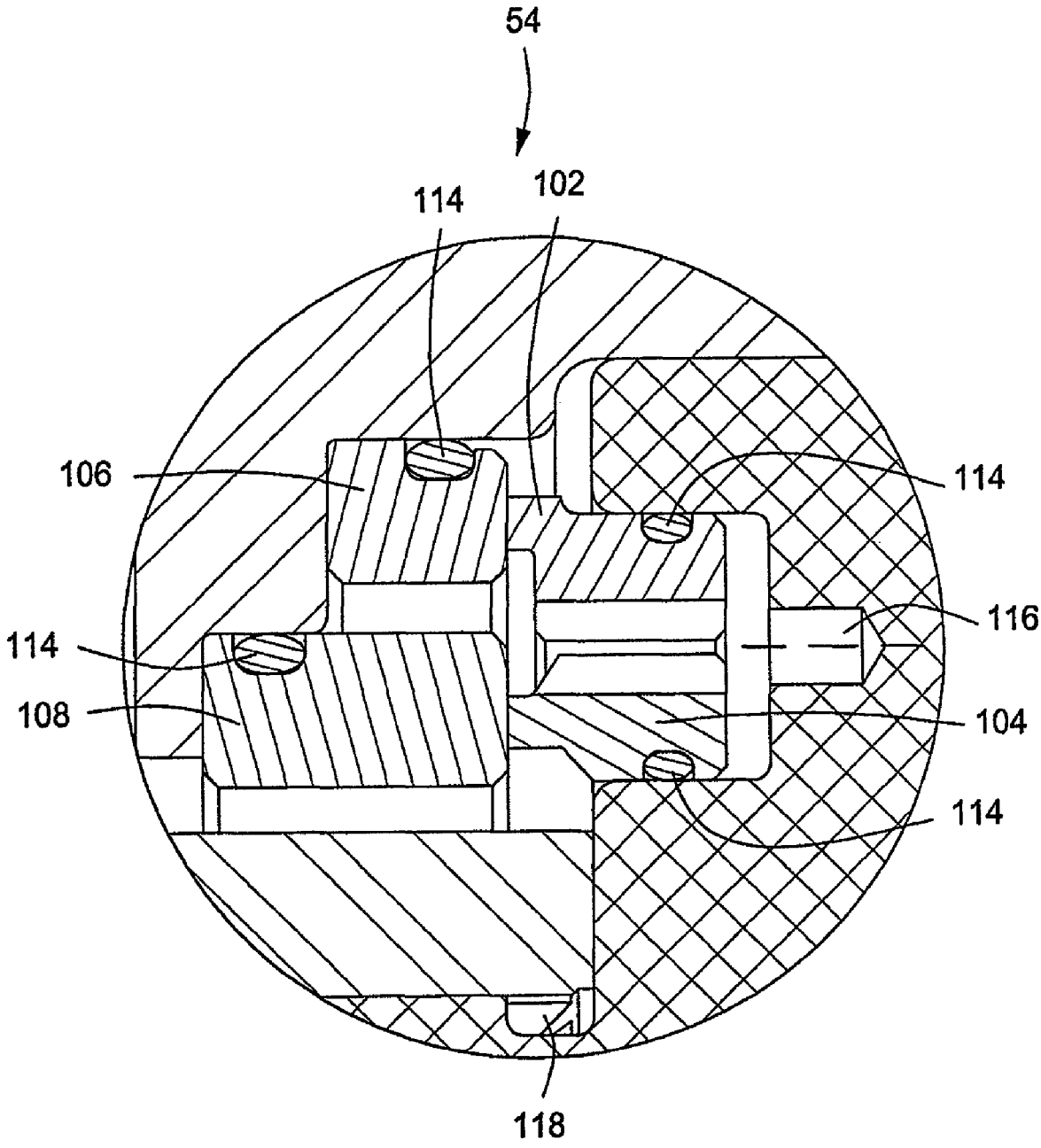
FIG. 5 is a more detailed view of a portion of FIG. 4.

FIGS. 4 and 5 are close up views showing in particular the material seal arrangement 54. The seal material 56 is similar to seal material 54 and thus is not separately described. Referring now to FIGS. 4 and 5, a seal 54 is shown providing a material seal between the rotor 46 and the body 24. The seal 54 includes an outer front seal ring that serves as a rotating primary seal 102, an inner front seal ring that serves as a rotating secondary seal 104, an outer rear sealing ring that serves as a stationary primary seal 106, and an inner rear seal ring that serves as a stationary secondary seal 108. If any of the material being pumped breaches this seal 56, it will exit through a clearance 110 and become visible from outside the pump. Also any breached pumped material will not enter the gear case, since it will be blocked by the lip seal 75.

Turning to FIG. 5, o-ring channels 114 are provided on each seal 102, 104, 106, and 108 to hold o-rings. The o-rings provide a frictional holding resistance to hold each seal in place during assembly and disassembly of the rotors and seals as will be explained in more detail below. A pin bore 116 is provided to hold a pin that is not shown. The pin extends into a feature in the seals 102 and 104 and thus ensures the seals 102 and 104 rotate together with the rotor 46. Any number of such pins may be used, spaced around the circumference of the seal rings. FIG. 5 also shows a corner relief 118 that can be provided for manufacturing reasons.

Figure 6:
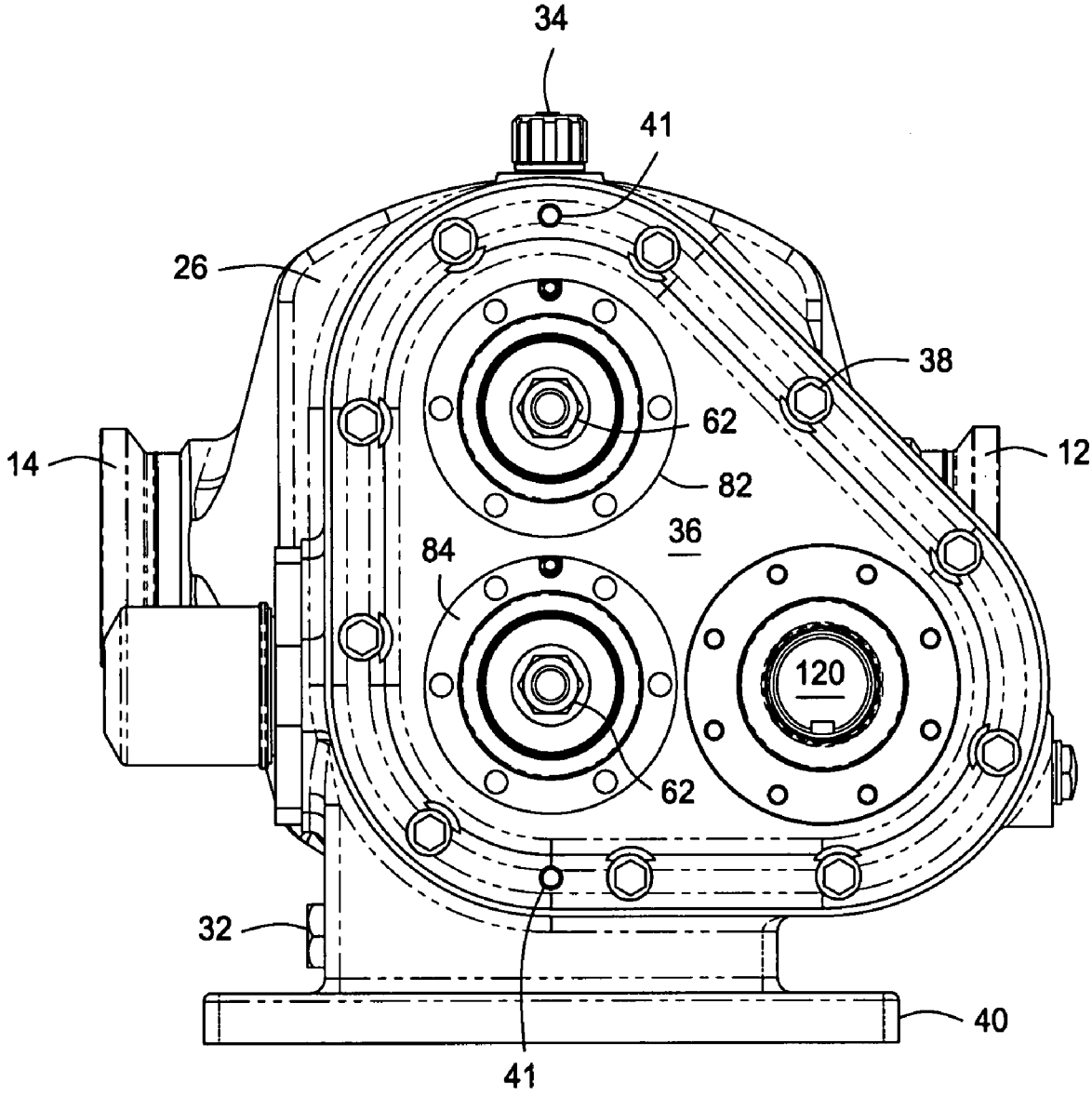
FIG. 6 is a rear view of the pump.

FIG. 6 shows a third shaft, which is a main drive shaft 120 that is driven by a motor or a gear reducer from a motor, which is not shown. The drive shaft 120 extends outward from the pump to be coupled to such a drive source.

Figure 7:
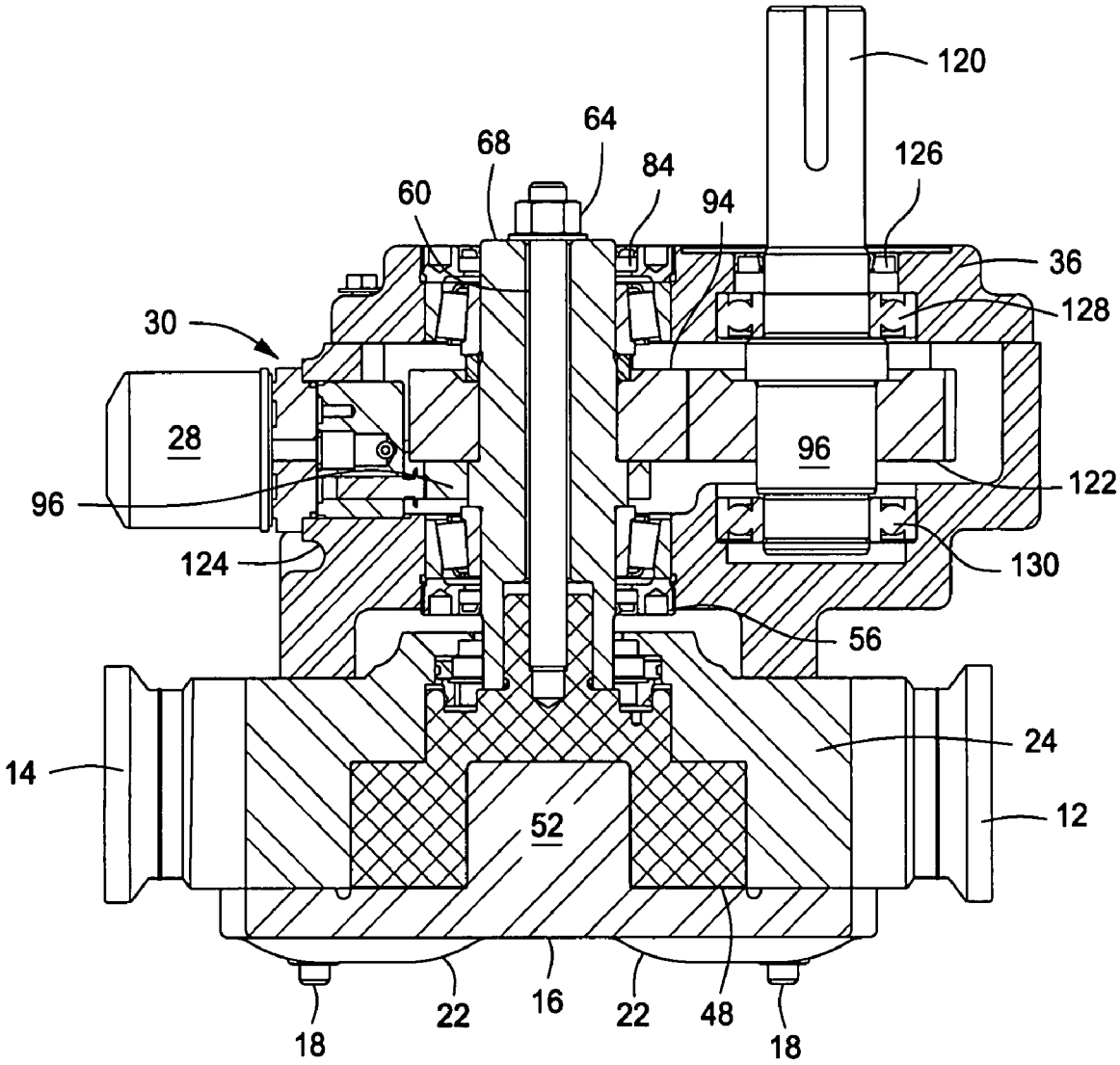
FIG. 7 is a cross-sectional view taken through line B-B in FIG. 6.

FIG. 7 illustrates the main drive shaft 120 having a drive gear 122 that meshes with drive gear 94 on the shaft 68. A spring biased follower pin 124 rides on the cam 96 and is reciprocated during operation. The reciprocation of the follower pin 124 operates the oil pump 30, which uses a pair of check valves that are described in more detail below with respect to FIGS. 18 to 23. A drive shaft lip seal 126 is provided where the main drive shaft 120 exits the rear cover 36. Drive bearings 128 and 130 support the main drive shaft 120 in the gear case 26 and rear cover 36.

Figure 8:
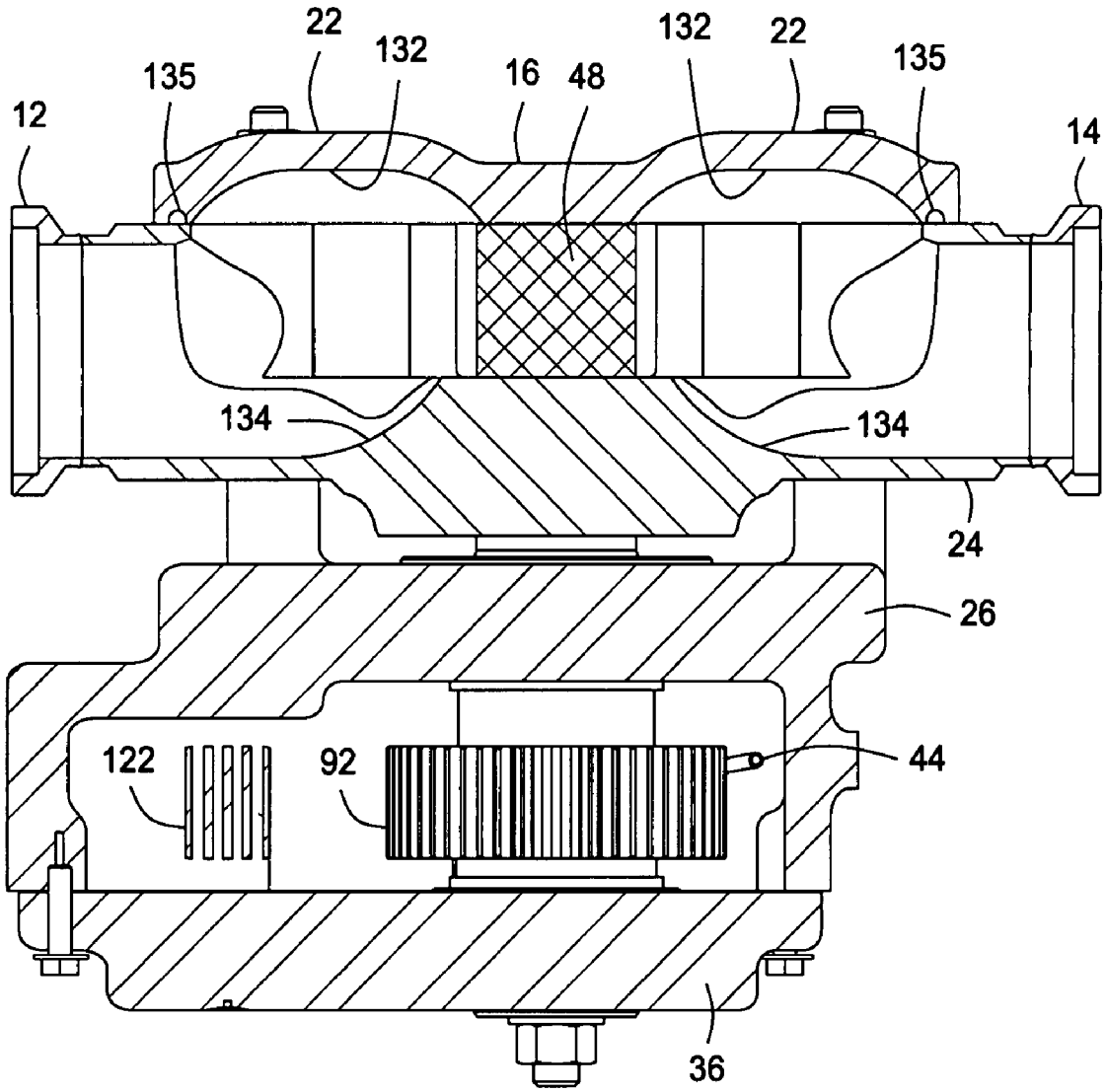
FIG. 8 is a cross-sectional view taken through line C-C in FIG. 2.

FIG. 8 shows the material inlet and outlet port regions. The front cover 16 has internal relief areas 132. When the wings are in their rotational position where they are not blocking the inlet, material flows into the space between the ears that will become the closed pump volume on further rotation. Material can also at this time flow into the space formed by the relief. This material can also enter the space between the ears from the front as well as the side of the rotor. This extra inlet flow path can enhance overall throughput and efficiency by reducing the degree of tortuous path, corners, and restriction in the inlet flow path. Similar benefits occur by having relief area 132 at the outlet side. Another relief area 134 is provided on the back side of the rotors, allowing material to enter the rotor spaces from the rear in a similar fashion. An o-ring 135 seals the front cover 16 against the body 24.

Figure 9:
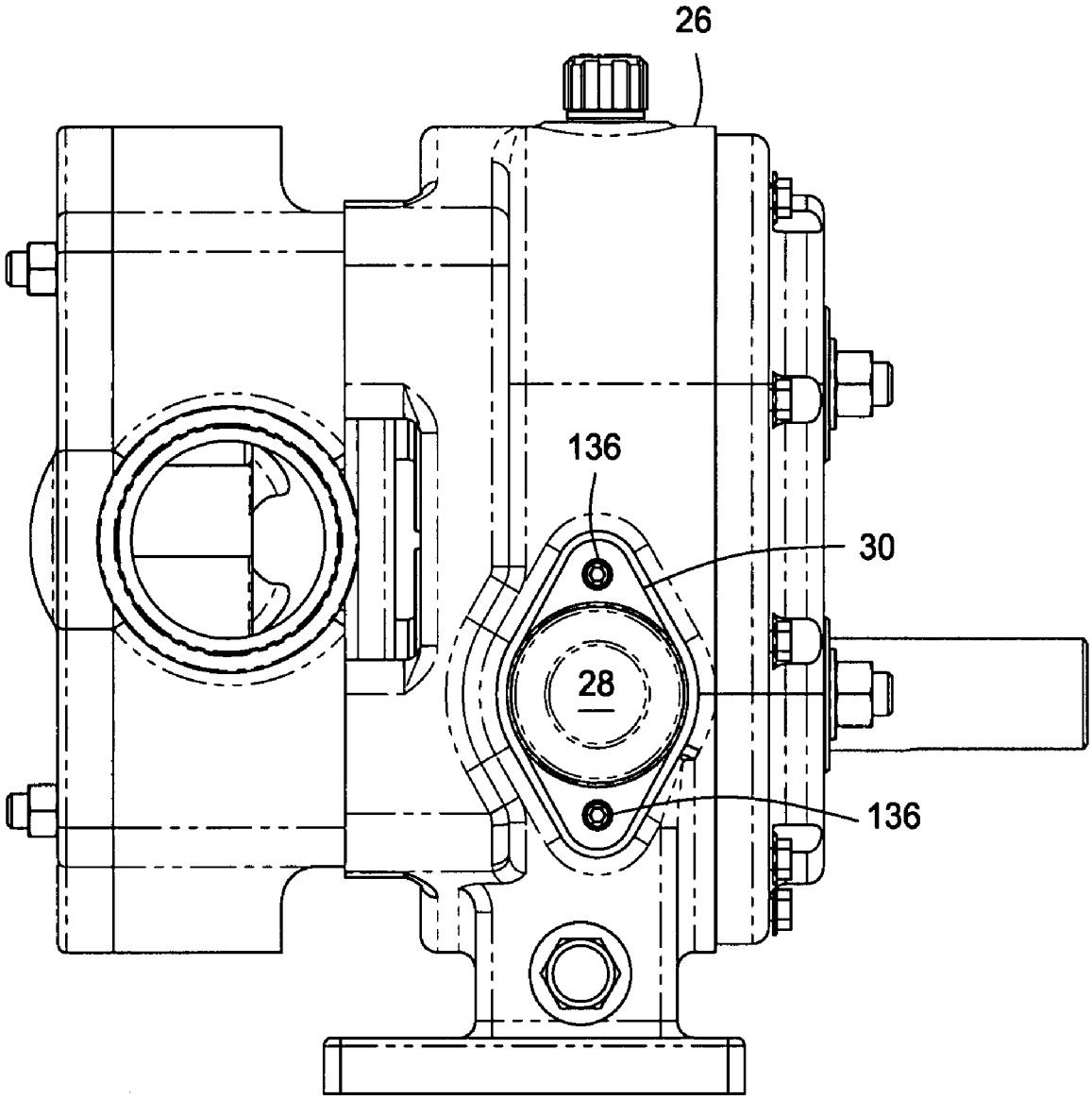
FIG. 9 is a right side view of the pump.
Figure 10:
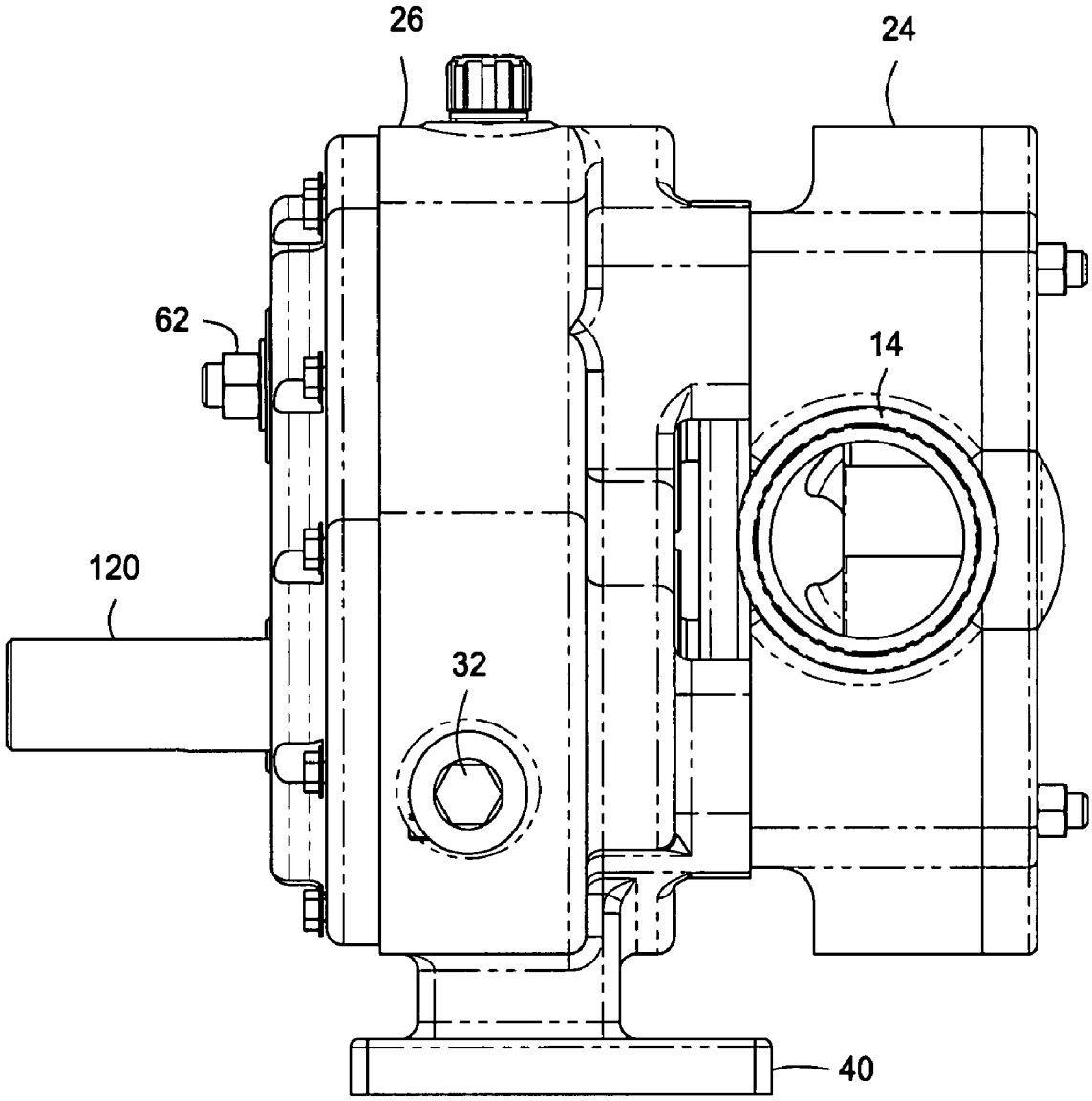
FIG. 10 is a left side view of the pump.
Figure 11:
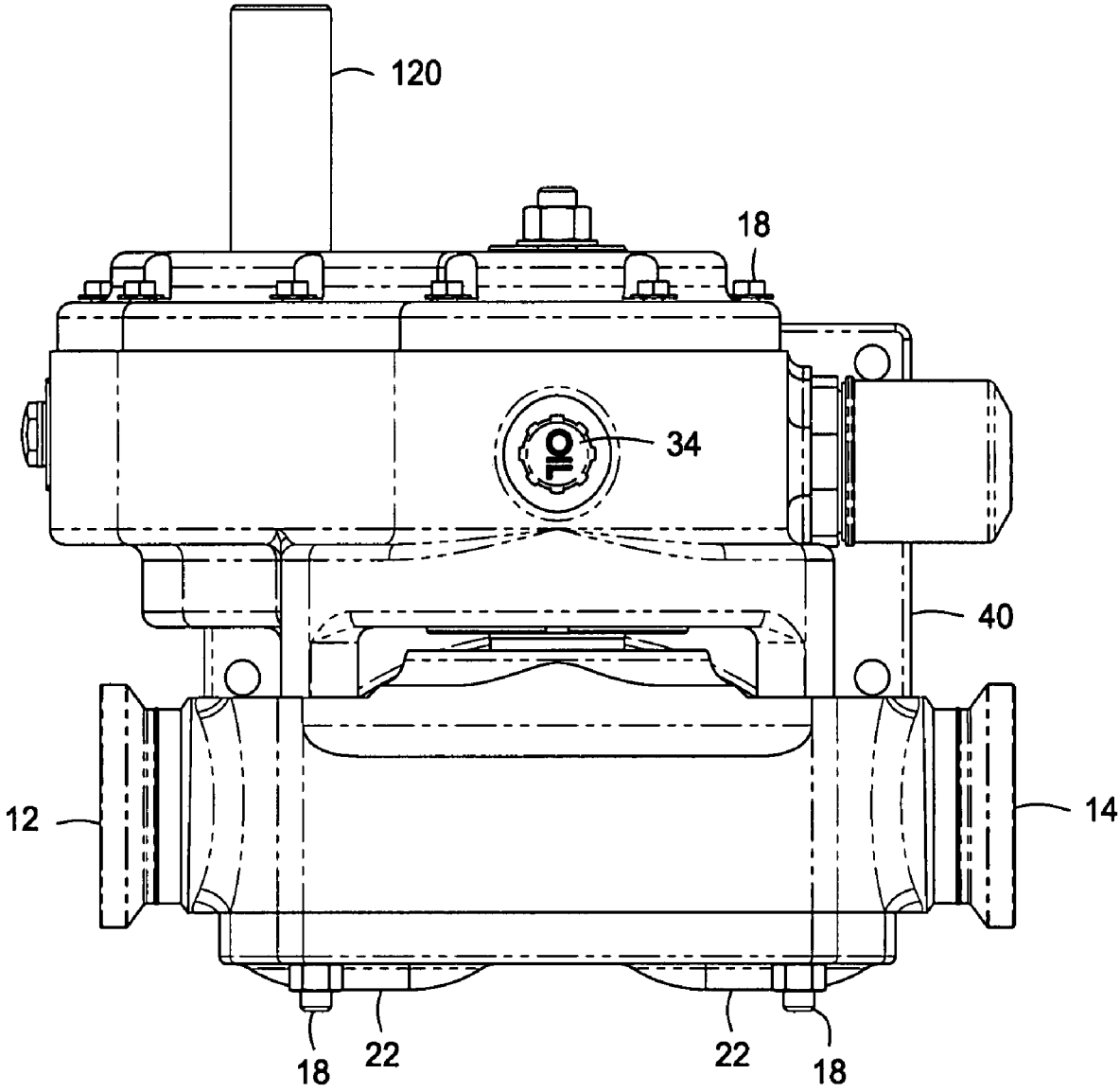
FIG. 11 is a top view of the pump.
Figure 12:
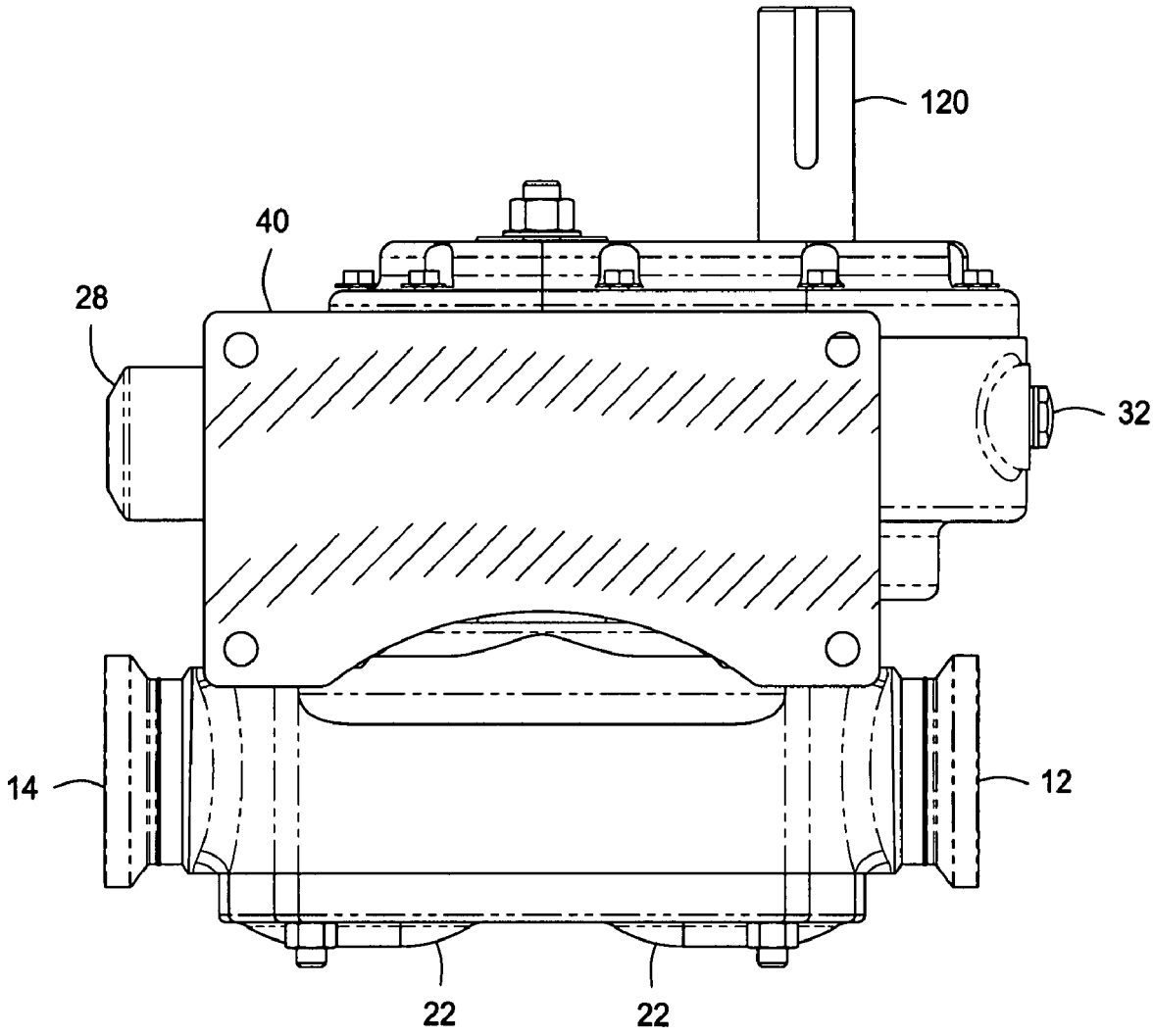
FIG. 12 is a bottom view of the pump.

FIG. 9 shows the pump 30 and filter 28 being attached to the gear case 26 by bolts 136. FIGS. 10, 11 and 12 show other views of the pump 10.

Figure 13:
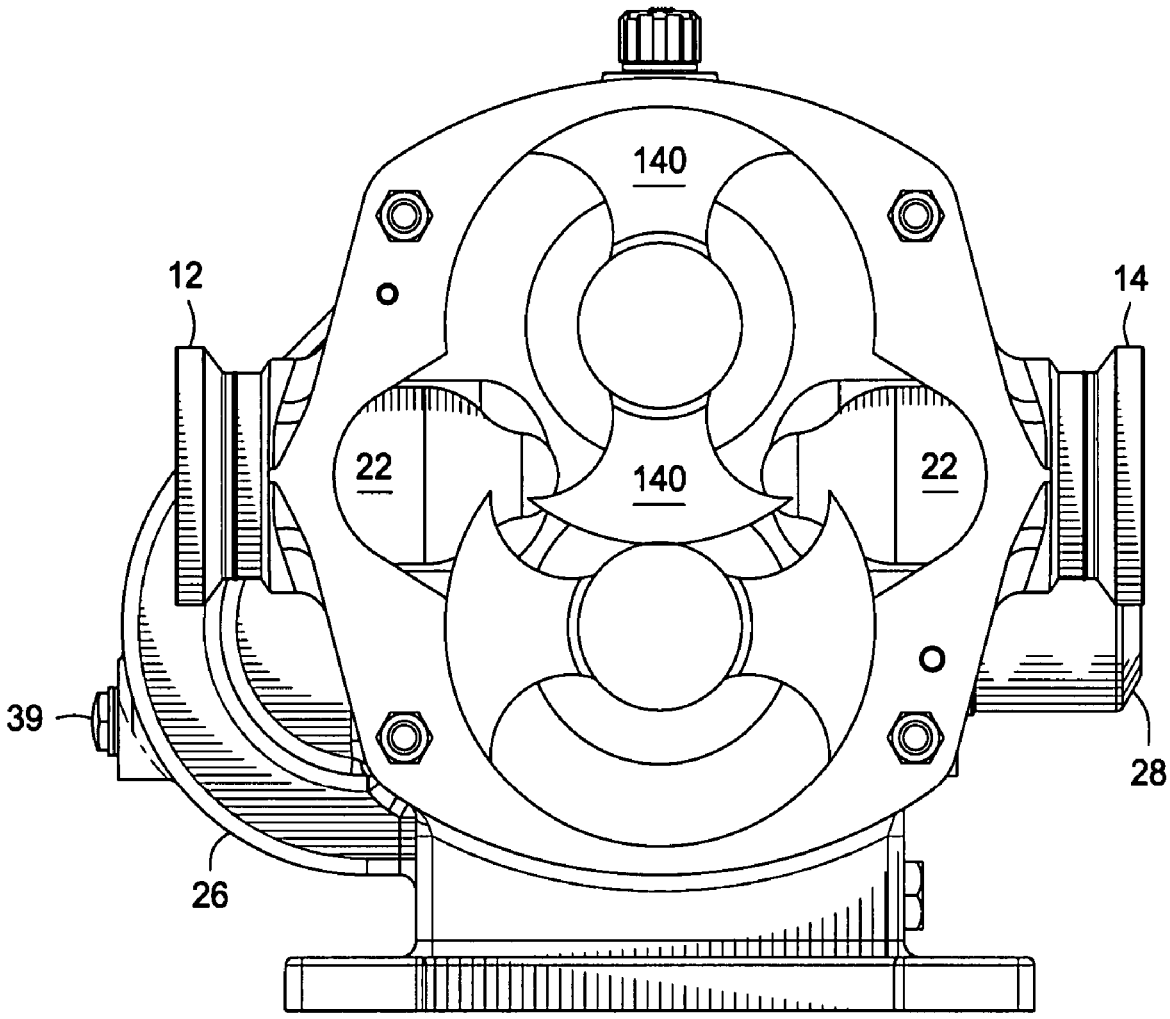
FIG. 13 is a cutaway front view of the pump.
Figure 14:
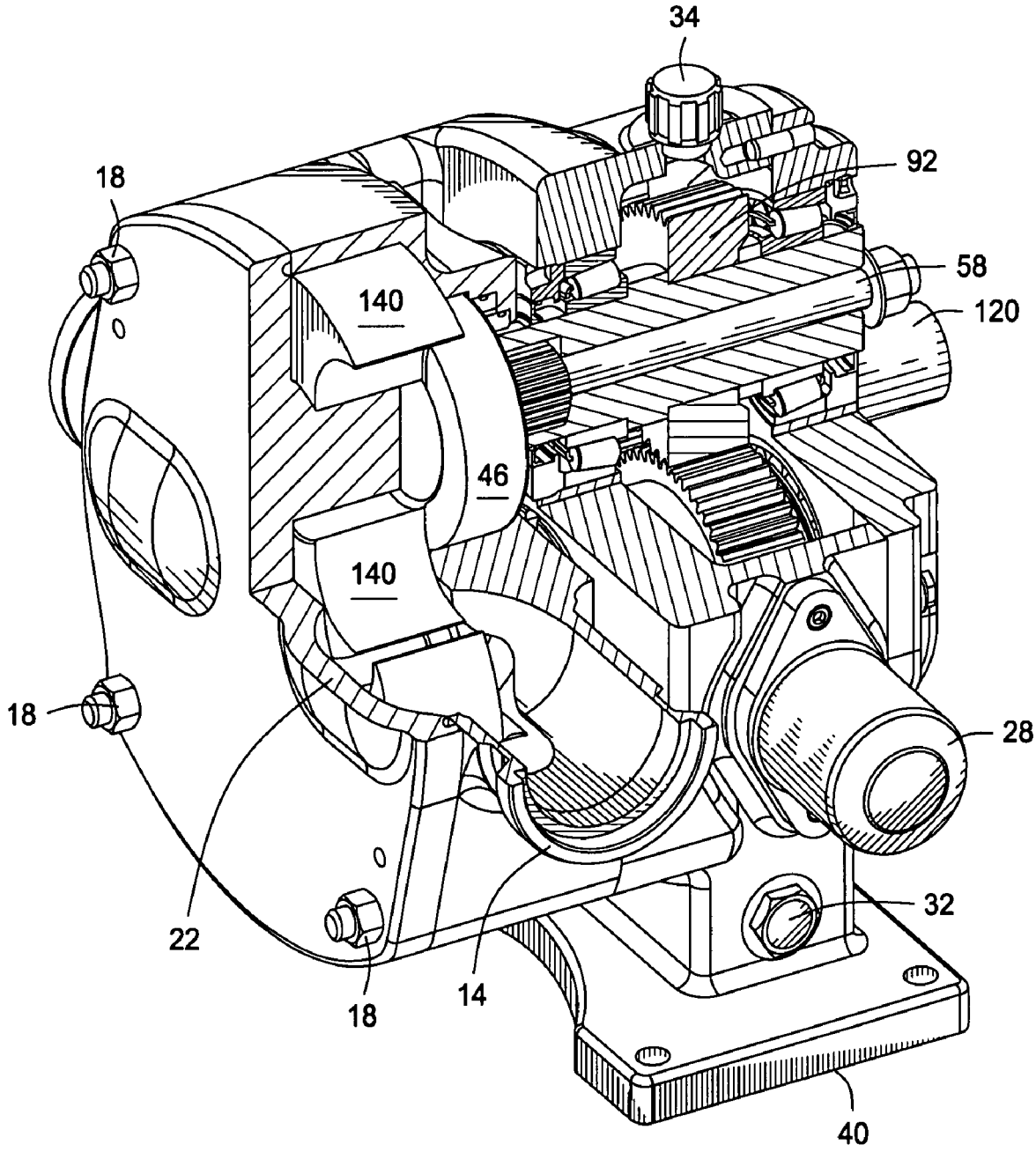
FIG. 14 is a cutaway perspective view of the pump.
Figure 15:
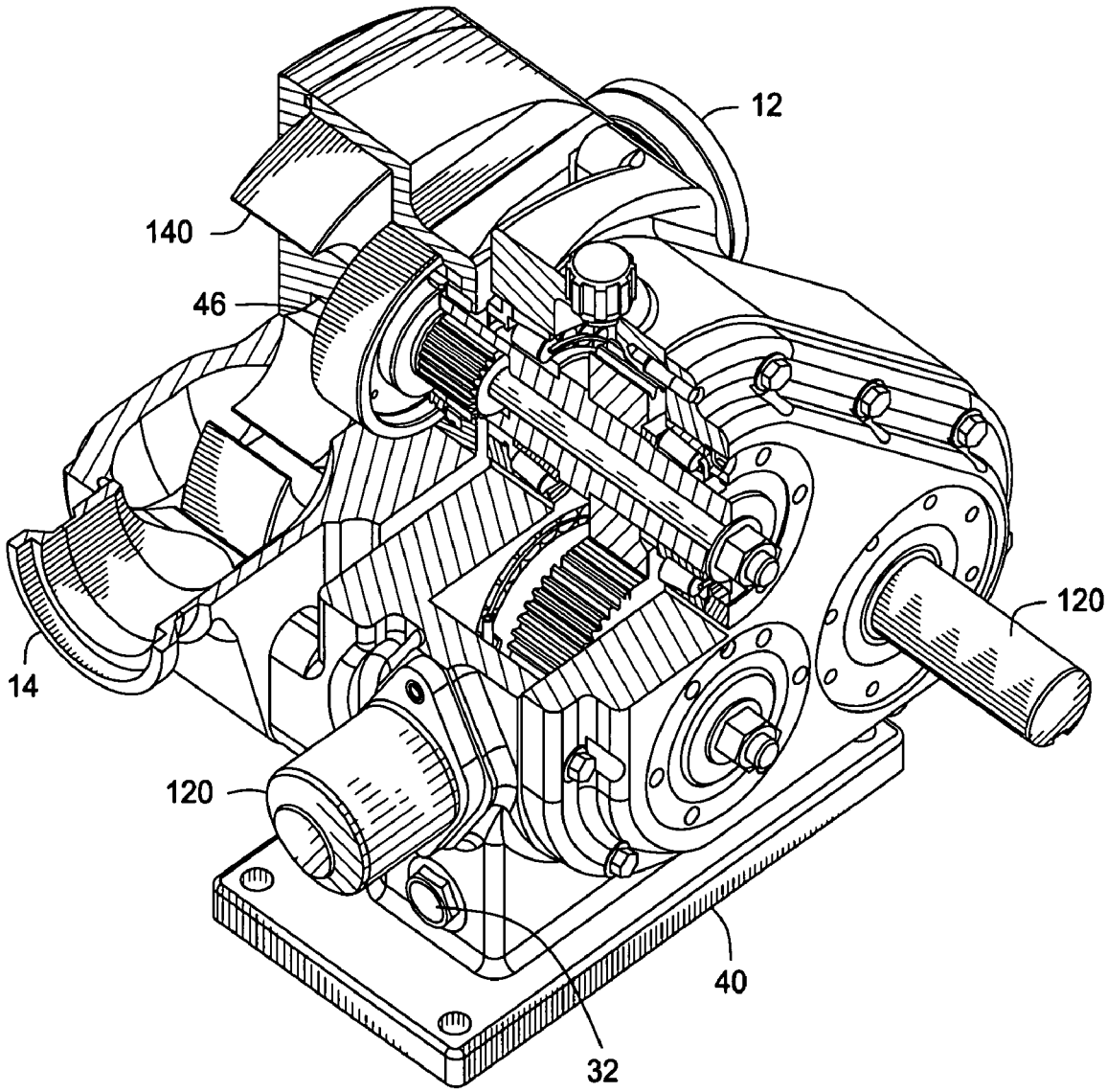
FIG. 15 is a cutaway perspective view of the pump.
Figure 16:
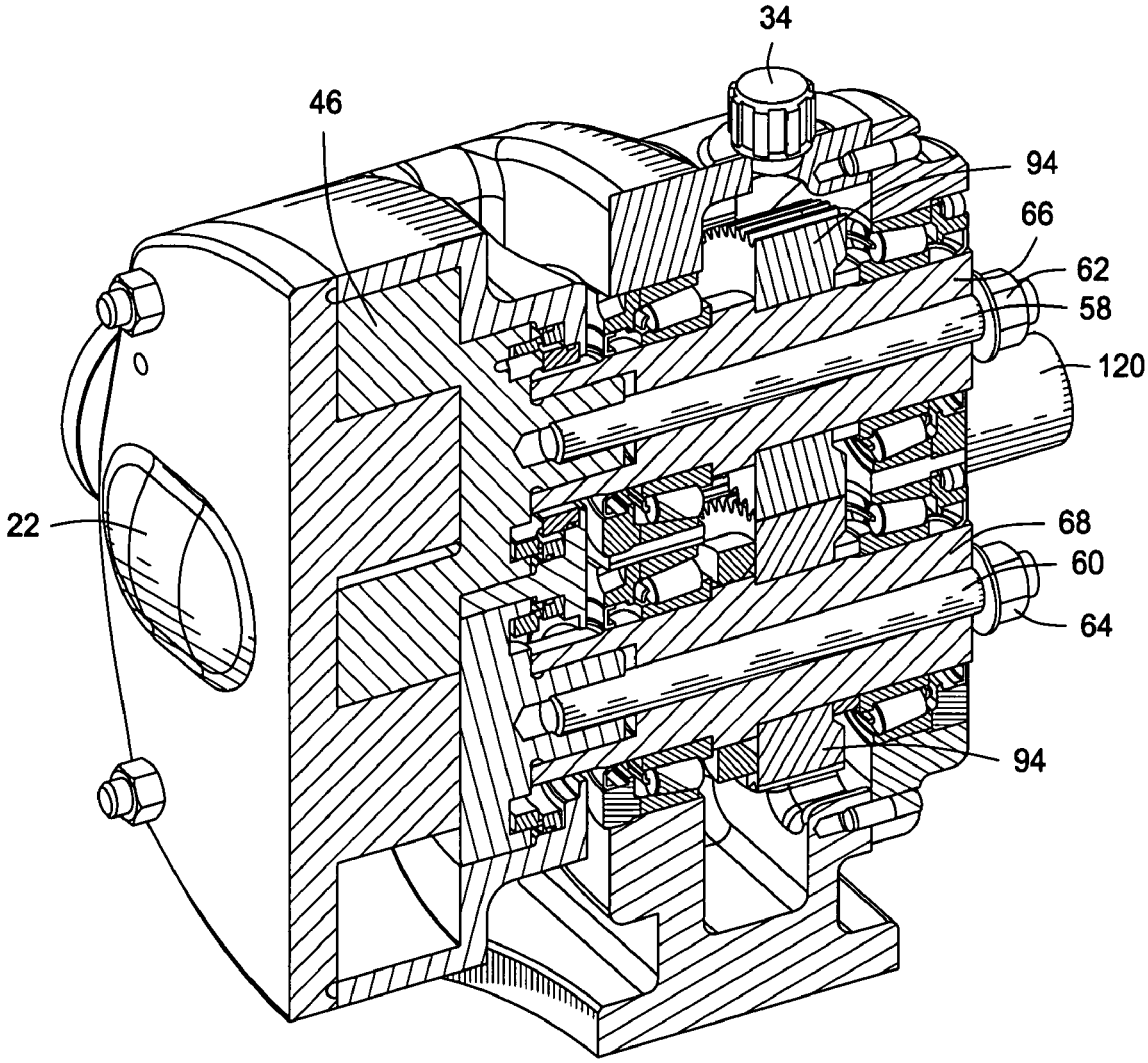
FIG. 16 is a cutaway perspective view of the pump.
Figure 17:
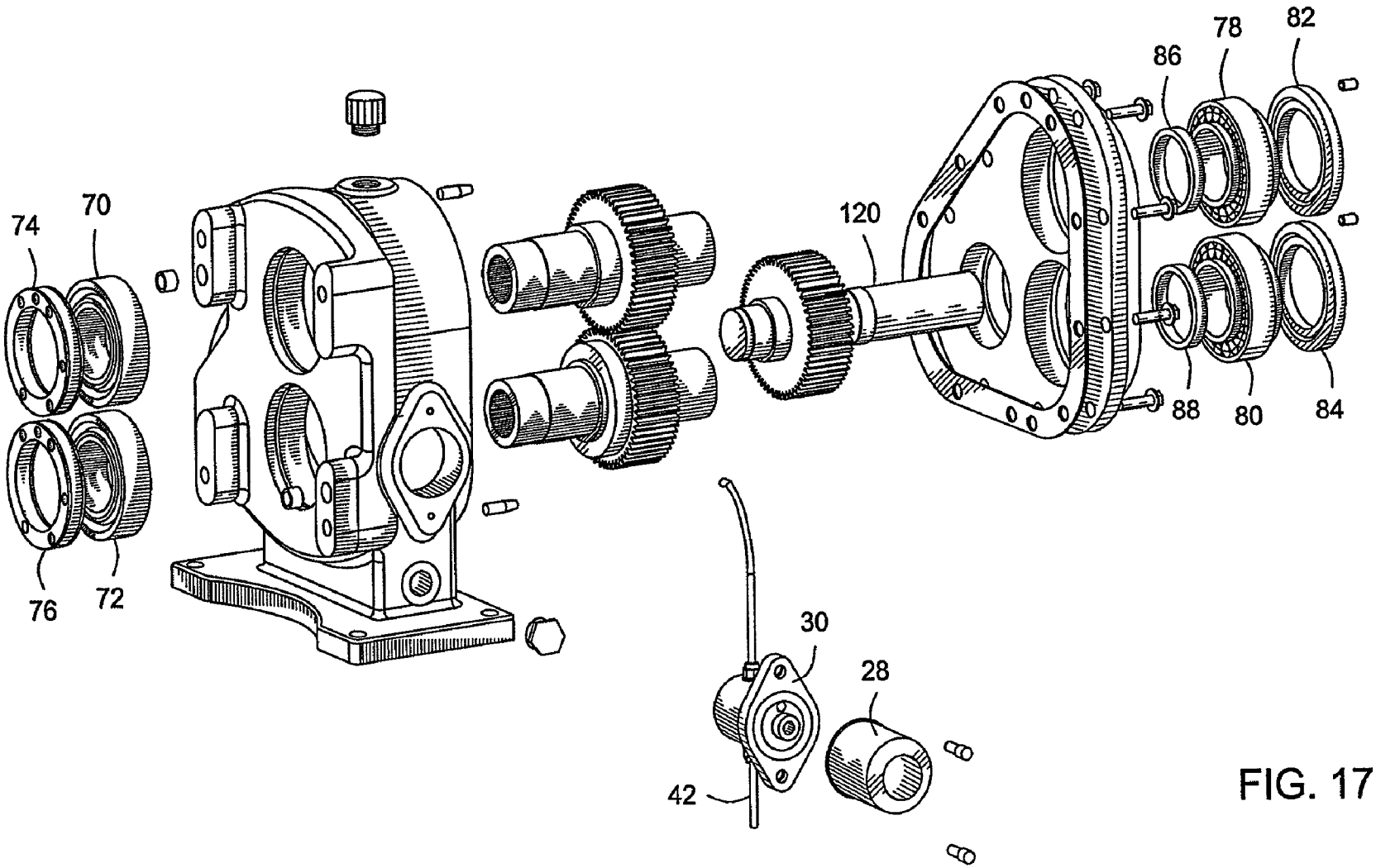
FIG. 17 is an exploded perspective view of a portion of the pump including the gear case and drive shafts.
Figure 20:
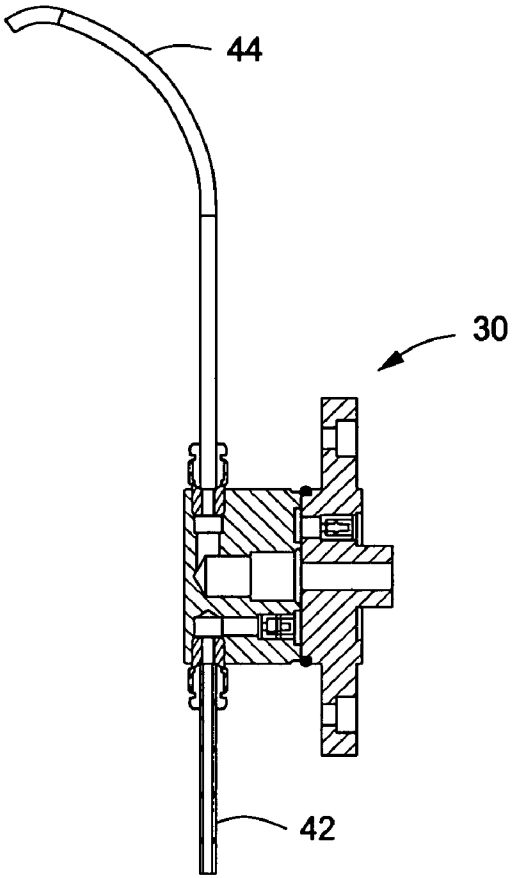
FIG. 20 is a cross-sectional view taken through line A-A in FIG. 19.
Figure 19:
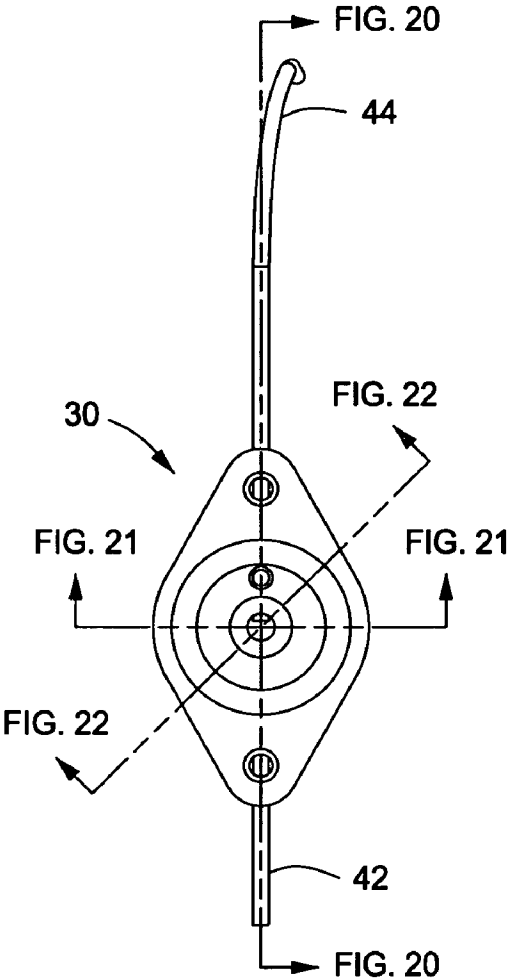
FIG. 19 is an opposite side view of the pump and filter assembly.
Figure 18:
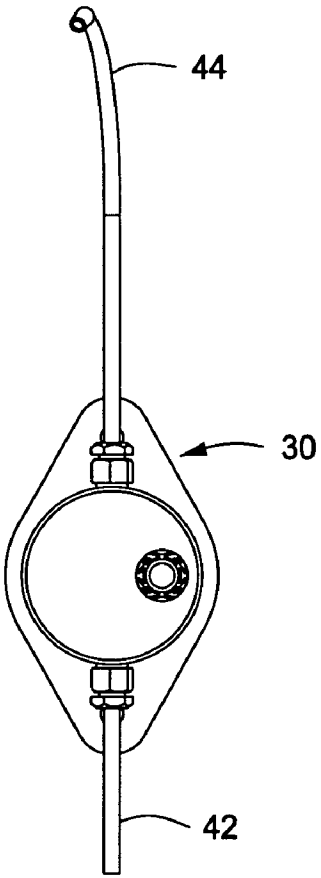
FIG. 18 is a side view of a pump and filter assembly.
Figure 22:
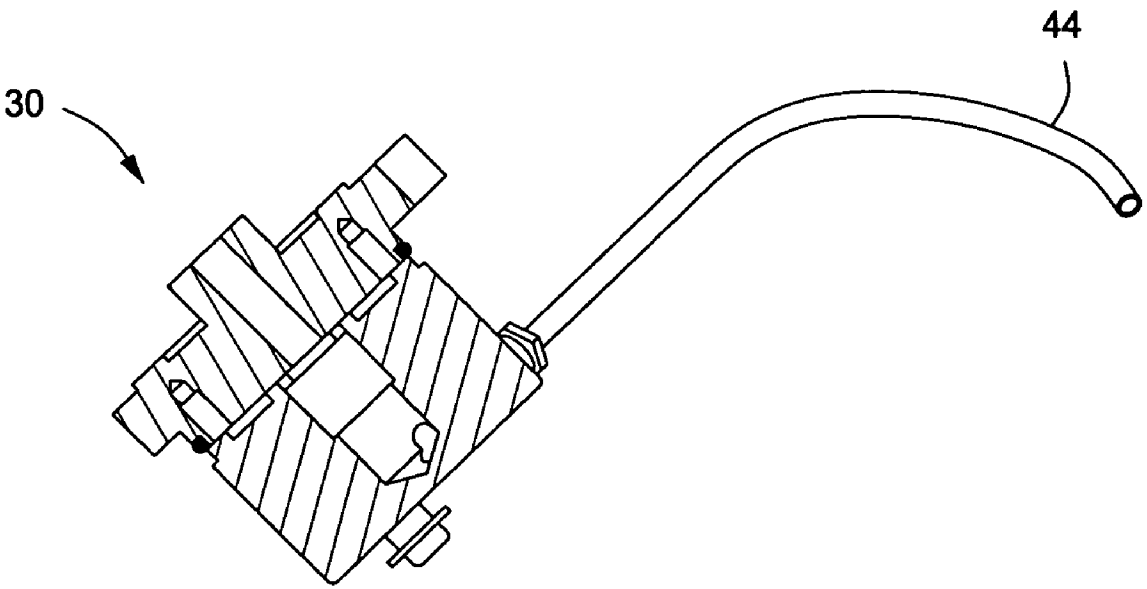
FIG. 22 is a cross-sectional view taken through line C-C in FIG. 19.
Figure 21:
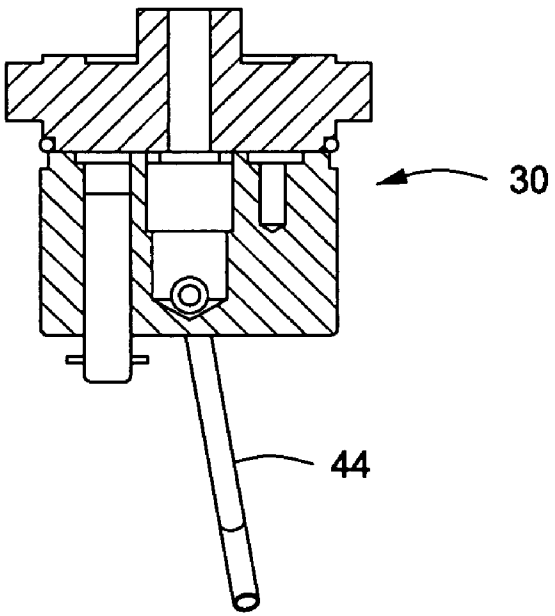
FIG. 21 is a cross-sectional view taken through line B-B in FIG. 19.
Figure 23:
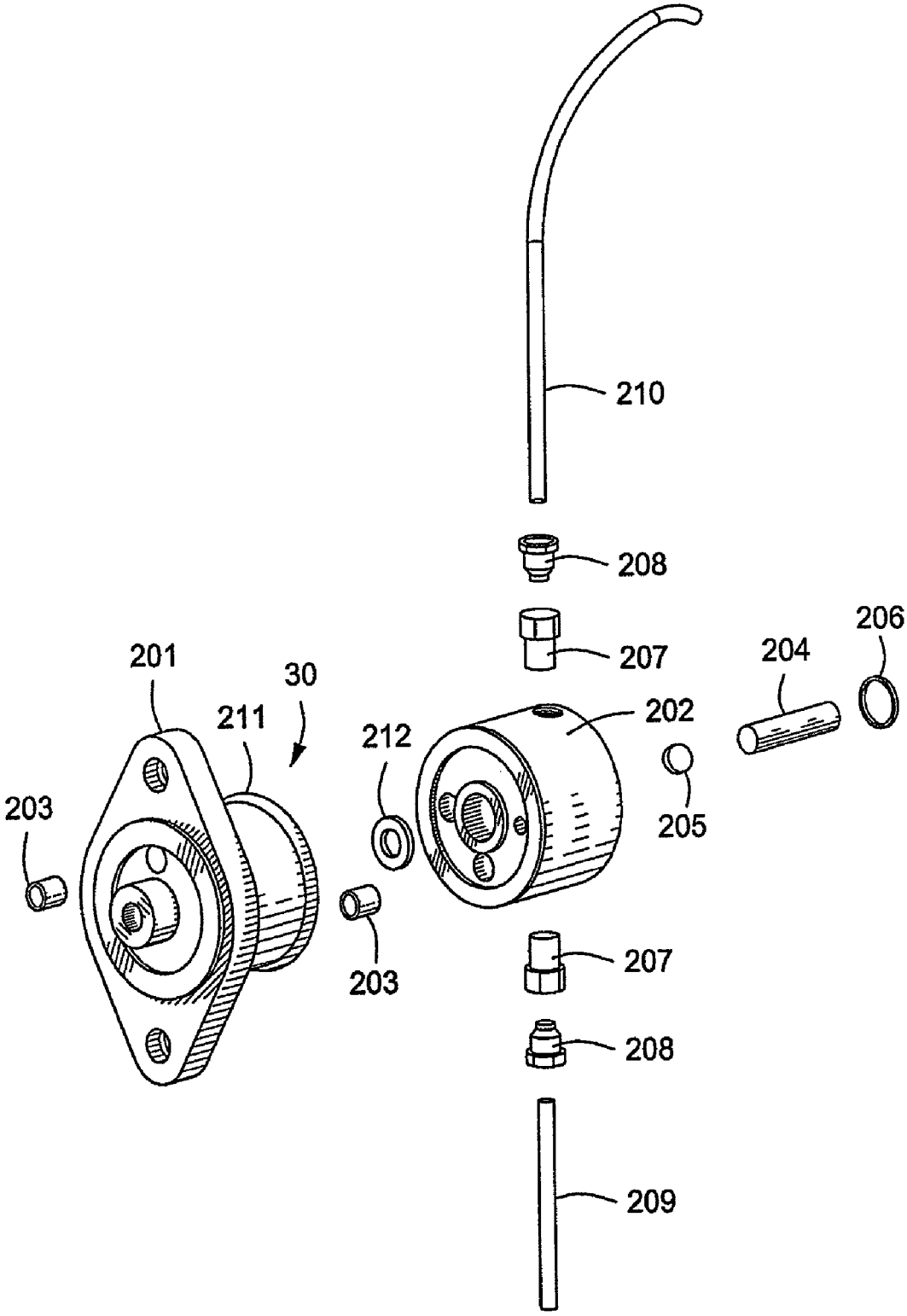
FIG. 23 is an exploded perspective view of the pump and filter assembly.

FIGS. 13 to 17 are cutaway views to show the pump 10 in that manner. In FIGS. 13 and 14, the ears 140 of the rotor 46 have been labeled. Other reference numerals are omitted from FIGS. 13 to 17 for clarity.

FIGS. 18 to 23 illustrate the pump assembly 30 in more detail. The pump assembly 30 includes a mounting flange 201, oil pump body 202, check valves 203, dowel pin 204, spring 205, and retaining ring 206. The dowel pin 204 corresponds to the reciprocating can follower pin 124 in FIG. 7. Fittings 207 and nuts 208 attach tubes 209 and 210. O-rings 211 and 212 are provided.

Referring now to all the figures, and especially FIG. 3, an example of steps for disassembly of the pump for cleaning or servicing will be described. The nuts 18 are removed. This permits the front cover 16 to be removed. The nuts 62 and 64 are removed. If desired, the studs 58 and 60 may be tapped forward, for example with a rubber hammer. This will cause the rotors 46 and 48 to protrude out beyond the front edge of the body 24. The rotors 46 and 48 can be grasped and pulled forward, thus removing the rotors 46 and 48 and their respective studs 58 and 60 each in one piece. The rotating seals 102 and 104 (see FIG. 5) are retained with the rotors 46 and 48 by their o-rings and thus are removed from the pump together with the rotors 46 and 48. The seals 102 and 104 then can be removed manually from the rotors as desired. The stationary seals 106 and 108 will remain retained in the body 24 due to their o-rings. The stationary seals 106 and 108 can also now be accessed and removed manually as desired. Upon completion of the steps described above, the hollow shafts 66 and 68 remain in the gearbox 26, and the gearbox interior remains sealed from the outer environment.

Some aspects of various features and embodiments described above can provide useful benefits. For example, in the disassembly steps described above, the rotors and seals all can be removed and serviced by removing the front cover 16, without the need to remove the body 24 from the gear case 26. Other than removal of the bolts 62, this process can be referred to as being front-loaded. Also, the area contacted by the pumped material is sealed by only three seal locations: (1) the front cover o-ring 135 (see FIG. 8), and (2 and 3) seals 54 and 56 for each rotor. Seals 54 and 56 each include the primary and secondary seal rings. There is no need for any seal to contact the rotating drive shaft, and no need to remove the drive shaft for rotor or seal replacement. Also any material that breaches any of the three seals is visible from outside the pump. Another feature of some embodiments is that there are no threaded connections located inside the pumped material flow path, and the connection of each rotor to its drive shaft occurs outside of the sealed material path. Also if desired a highly complimentary fit between the hubs 50 and 52 and the inside diameter of the wings of the respective rotors 46 and 48 can be accomplished which can reduce unswept/non-pumping area. Another feature of some embodiments is that an enclosed gear case chamber is provided that is sealed by five lip seals (lip seals 75, 77, 83 and 84, as well as the drive shaft lip seal 126) and any oil that breaches the lip seals is also visible from outside the pump.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A pump, comprising:

a front cover;

a pump body forming a chamber with the front cover;

a pair of hollow drive shafts, each drive shaft having a first end and a second end;

a gear case supporting the pair of hollow drive shafts;

a pair of mounting studs;

a pair of fasteners;

a pair of rotors disposed in the chamber and each detachably mounted to the first end of a respective hollow drive shaft via a respective mounting stud that extends from the rotor through the respective hollow drive shaft to a respective fastener at the second end of the hollow drive shaft; and an oil pump to circulate oil or other lubricant inside the gear case, wherein the oil pump is a reciprocating pump driven by a cam disposed on one of the drive shafts.

2. A pump according to claim 1, wherein each drive shaft and each rotor engage with each other via a spline connection.

3. A pump according to claim 2, wherein each stud is directly attached to each rotor proximate the axial location of the splines.

4. A pump according to claim 3, wherein each mounting stud extends outward past the respective drive shaft at the second end of a drive shaft opposite the rotor, and wherein the fasteners are each engagable with the extending part of each mounting stud to axially fix the position of the stud relative to the position of the respective drive shaft.

5. A pump according to claim 4, wherein the extending part of each stud is threaded and wherein each fastener is a nut that also contacts the second end of the drive shaft.

6. A pump according to claim 1, wherein each stud has an outer diameter that is smaller than an inner diameter of each hollow shaft.

7. A pump, comprising:

a front cover;

a pair of drive shafts;

a pump body forming a chamber with the front cover;

a gear case supporting the hollow drive shafts;

a pair of rotors disposed in the chambers, wherein each rotor is driven by a respective drive shaft and each drive shaft is mounted to the gear case by a pair of bearings that rotatably support the shaft in the gear case, with each bearing being located relative to the gear case by a respective locating ring that is axially movable relative to the gear case, so that each bearing is axially adjustable relative to the gear case; and an oil pump to circulate oil or other lubricant inside the gear case, wherein the oil pump is a reciprocating oil pump driven by a cam on one of the drive shafts.

8. A pump according to claim 7, wherein axial adjustment of both bearings of a respective drive shaft in one direction moves the drive shaft in that direction.

9. A pump according to claim 8, wherein for each drive shaft, the first bearing retainer is located axially outside of the first bearing, and the second bearing retainer is located axially outside the second bearing, so that the bearings are both trapped between the bearing retainers.

10. A pump according to claim 9, wherein the bearings each contact a respective shoulder located on the drive shaft, in between the bearings, so that tightening of both bearing retainers urges the bearings axially inward to abut their respective shoulder.

11. A pump according to claim 7, wherein each locating ring comprises an externally threaded ring residing in an internally threaded bore of the gear case.

12. A pump according to claim 7, wherein axial adjustment of both bearings of a respective drive shaft in one direction moves the drive shaft in that direction.

13. A pump according to claim 7, wherein each locating ring comprises an externally threaded ring residing in an internally threaded bore of the gear case.

14. A pump according to claim 13, further comprising a respective set screw for locking the position of each bearing retainer.

15. A pump according to claim 7, wherein the first bearing retainer is located axially outside of the first bearing, and a second bearing retainer is located axially outside the second bearing, so that the bearings are trapped between the bearing retainers.

16. A pump according to claim 7, wherein the bearings each contact a respective shoulder located on the drive shaft, in between the bearings, so that tightening of both bearing retainers urges the bearings axially inward to abut their respective shoulder, thereby adjusting the internal clearance of each bearing.

17. A pump, comprising:

a front cover;

a pair of drive shafts;

a pump body forming a chamber with the front cover;

a gear case supporting the hollow drive shafts;

a pair of rotors disposed in the chambers, wherein each rotor is driven by a respective drive shaft and each drive shaft is mounted to the gear case by a pair of tapered bearings to rotatably support the shaft in the gear case, with each bearing being located relative to the gear case by a respective locating ring that is axially movable relative to the gear case, so that an internal clearance of each bearing is adjustable by adjusting the distance between the locating rings, and an oil pump to circulate oil or other lubricant inside the gear case, wherein the oil pump is a reciprocating oil pump driven by a cam on one of the drive shafts.

* * * * *